US008424114B2

(12) United States Patent
Snyder et al.

(10) Patent No.: US 8,424,114 B2
(45) Date of Patent: Apr. 23, 2013

(54) CONVERTIBLE GARMENT

(75) Inventors: Brian T. Snyder, Portland, OR (US); Mitchell S. Zapp, Washougal, WA (US); William K. Inman, Portland, OR (US)

(73) Assignee: Wolverine World Wide, Inc., Rockford, MI (US)

( * ) Notice: Subject to any disclaimer, the term of this patent is extended or adjusted under 35 U.S.C. 154(b) by 399 days.

(21) Appl. No.: 12/581,499

(22) Filed: Oct. 19, 2009

(65) Prior Publication Data

US 2011/0088135 A1 Apr. 21, 2011

(51) Int. Cl.
*A41D 3/02* (2006.01)

(52) U.S. Cl.
USPC ..... 2/86

(58) Field of Classification Search ..... 5/485, 489, 5/490, 636, 637; 224/624, 625, 662; 2/85, 2/86, 89, 93, 94, 97, 102, 108, 247, 249–251, 2/DIG. 2
See application file for complete search history.

(56) References Cited

U.S. PATENT DOCUMENTS

| | | | | | |
|---|---|---|---|---|---|
| 2,142,814 | A | * | 1/1939 | Fitch | 2/93 |
| 2,143,931 | A | * | 1/1939 | Aronson | 2/93 |
| 2,146,243 | A | * | 2/1939 | Aug | 2/85 |
| 2,150,251 | A | * | 3/1939 | Shanhouse | 2/94 |
| 2,292,347 | A | * | 8/1942 | Bailey | 2/93 |
| 2,324,722 | A | * | 7/1943 | Papierniak | 2/93 |
| 2,325,494 | A | * | 7/1943 | Fayer | 2/93 |
| 2,825,902 | A | * | 3/1958 | Breier | 2/93 |
| 2,959,789 | A | * | 11/1960 | Mills et al. | 2/93 |
| 3,670,340 | A | * | 6/1972 | Walker | 2/93 |
| 3,782,614 | A | * | 1/1974 | Campisi | 2/251 |
| 4,404,687 | A | | 9/1983 | Hager | |
| 4,404,689 | A | * | 9/1983 | DeWan | 2/247 |
| D277,048 | S | * | 1/1985 | Peyser | D2/831 |
| D277,049 | S | * | 1/1985 | Peyser | D2/831 |
| 4,543,669 | A | * | 10/1985 | Katz | 2/84 |
| 4,554,682 | A | | 11/1985 | Hillquist | |
| 4,700,409 | A | * | 10/1987 | De Lott | 2/94 |
| 4,754,512 | A | * | 7/1988 | Chao-Yang | 5/482 |
| 5,046,980 | A | * | 9/1991 | Tai et al. | 446/73 |

(Continued)

OTHER PUBLICATIONS

Web page showing Lole Breezy Reversible jacket.

(Continued)

*Primary Examiner* — Alissa L Hoey
(74) *Attorney, Agent, or Firm* — Warner Norcross & Judd LLP

(57) ABSTRACT

A convertible garment that is reconfigurable from a garment to a neck pillow. The neck pillow may be generally U-shaped to fit about the neck of a wearer. The garment may include a pocket generally corresponding in shape to desired shape of the neck pillow. The pocket is of sufficient size to receive the remainder of the garment so that the remainder of the garment can be inserted into the pocket. The pocket may be sized so that the remainder of the garment substantially fills the pocket, thereby providing a relatively firm neck pillow capable of providing the desired level of neck support. The pocket may have a closure, such as a zipper, to retain the remainder of the garment in the pocket. The garment may be a jacket with the pocket located in the lower back that opens to the inside of the garment. The pocket may be manufactured from or lined with a soft material, such as a brushed tricot or a fleece.

3 Claims, 5 Drawing Sheets

U.S. PATENT DOCUMENTS

| | | | | | |
|---|---|---|---|---|---|
| 5,452,476 | A | * | 9/1995 | Jenks | 2/46 |
| 5,564,125 | A | * | 10/1996 | Waldman et al. | 2/93 |
| 5,787,504 | A | * | 8/1998 | Wu | 2/93 |
| 5,794,264 | A | * | 8/1998 | Yuen | 2/93 |
| 5,815,833 | A | | 10/1998 | Kuo | |
| 5,850,634 | A | * | 12/1998 | Toombs | 2/93 |
| D414,013 | S | | 9/1999 | Group | |
| 6,009,577 | A | * | 1/2000 | Day | 5/636 |
| 6,126,507 | A | * | 10/2000 | Lieberman | 446/327 |
| 6,405,377 | B1 | | 6/2002 | Davis | |
| 6,421,852 | B1 | * | 7/2002 | Shao | 5/413 R |
| 6,427,267 | B1 | * | 8/2002 | Turner | 5/482 |
| 6,532,611 | B1 | * | 3/2003 | Day | 5/636 |
| 6,564,388 | B1 | * | 5/2003 | Poston | 2/86 |
| 6,598,248 | B1 | * | 7/2003 | Ong | 5/636 |
| 6,708,355 | B1 | * | 3/2004 | Wang et al. | 5/644 |
| 7,143,450 | B2 | * | 12/2006 | Green, III | 2/94 |
| D590,134 | S | * | 4/2009 | Rogondino | D2/831 |
| 7,657,954 | B1 | * | 2/2010 | Bunkers | 5/644 |
| D626,725 | S | * | 11/2010 | Snyder et al. | D2/831 |
| 8,032,948 | B2 | * | 10/2011 | Anderson | 2/69 |
| 2005/0155152 | A1 | * | 7/2005 | Coats et al. | 5/636 |
| 2005/0198723 | A1 | * | 9/2005 | Green | 2/93 |
| 2009/0205096 | A1 | * | 8/2009 | Seemann | 2/4 |
| 2009/0241235 | A1 | * | 10/2009 | Weinreb | 2/84 |

OTHER PUBLICATIONS

First photo of Lole Breezy Reversible jacket.
Second photo of Lole Breezy Reversible jacket turned inside out showing internal packet.
Third photo of Lole Breezy Reversible jacket stored in internal pocket.
Fourth photo of Lole Breezy Reversible jacket stored in internal pocket.
Cole Haan website showing Packable Jacket, at least as early as Oct. 19, 2009.

* cited by examiner 14
86
88
94
7" deep
54
5" wide
92
84
11" deep
90
50
82
16
60
80
12" wide 14
54
50
82
2.5" Tall
88
90
86
84
52

14
60
16
50
8" zipper
54
84
80
82
52

CONVERTIBLE GARMENT

BACKGROUND OF THE INVENTION

The present invention relates to garments, and more particularly to garments that are convertible for alternative purposes.

A variety of convertible jackets is available on the market. Generally speaking, a convertible jacket is a jacket that can be worn as a jacket when desired and selectively converted into an alternative configuration when a jacket is not desired. For example, a conventional convertible jacket may include a pocket in which the remainder of the jacket can be stuffed for storage. The pocket may include a zipper so that the remainder of the jacket can be securely closed within the pocket. Convertible jackets are useful in a variety of situations, including those where the wearer may move from outdoors where a jacket is desired to indoors where no jacket is desired. Convertible jackets can be particularly useful in the context of travel where the wearer may move from outside to the inside of a transit terminal and eventually to the inside of a plane, train or bus. To provide improved functionality for travel, some conventional convertible jackets include a pocket that is generally rectangular so that when the jacket is stuffed in the pocket, it can be used as a pillow.

Although existing convertible jackets are useful and provide dual-purpose functionality not available in non-convertible jackets, there remains a need for a convertible jacket that provides improved performance in at least select applications.

SUMMARY OF THE INVENTION

The present invention provides a convertible garment that is reconfigurable from a garment to a neck pillow. The neck pillow may be generally U-shaped to fit about the neck of a wearer. In one embodiment, the garment includes a pocket generally corresponding in shape to desired shape of the neck pillow. The pocket may be sized so that the remainder of the garment substantially fills the pocket, thereby filling out the pocket and providing a relatively firm neck pillow capable of providing the desired level of neck support.

In one embodiment, the pocket is a bag pocket having top and bottom generally U-shaped panels joined by one or more side panels. The pocket may include at least one exterior side panel that does not engage the wearer's neck when the convertible jacket is configured as a neck pillow. The pocket may include a closure, such as a zipper, to allow the pocket to be closed to retain the remainder of the garment in the pocket. The closure may be disposed in the exterior side panel where it will not be in contact with the wearer's skin when the convertible jacket is being used as a neck pillow. The pocket may include alternative closures, such as snaps, buttons and hook-and-loop fasteners.

The garment may be a jacket or other similar upper body outer garment. In one embodiment, the jacket may be filled with an insulation material, such as down or synthetic fibers. The characteristics of the insulation material may be selected to provide the desired balance between insulation for the garment and cushioning for the neck pillow.

In one embodiment, the pocket opens on the inside of the garment, for example, in a location where it is not visible when the garment is worn. The pocket may be located in the back of the garment. In such embodiments, the pocket may be located in the lower back of the garment with its opening on the inside of the garment.

In one embodiment, the pocket is formed from or lined with a soft material, such as brushed tricot or fleece. In such embodiments, the soft material forms at least portions of the exposed surface when configured as a neck pillow, thereby providing an aesthetically pleasing interface for at least a portion of the wearer's skin.

The present invention provides a convertible garment that can be selectively worn as a garment and easily converted into a neck pillow that can be fitted around a wearer's neck to provide cushioning and support for the neck. In those applications where the pocket is a bag pocket, the stuffed pocket can assume a true neck pillow shape. The neck pillow may provide improved comfort in those applications where the closure is placed on an exterior side panel where it will not engage the wearer's neck. Appropriate balance between pocket size, pocket shape and garment volume can be used to provide a neck pillow of sufficient firmness to provide proper neck support.

These and other objects, advantages and features of the invention will be more fully understood and appreciated by reference to the description of the current embodiment and the drawings.

DESCRIPTION OF THE CURRENT EMBODIMENT

Figure 1:
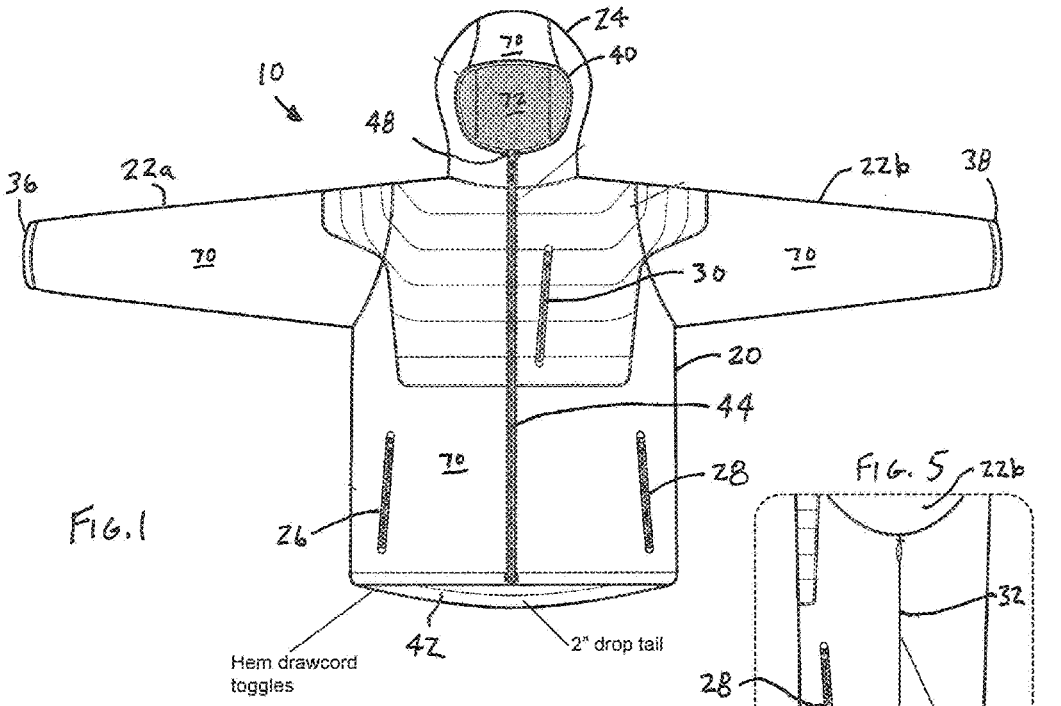
FIG. 1 is a front elevational view of a convertible jacket in accordance with an embodiment of the invention.
Figure 2:
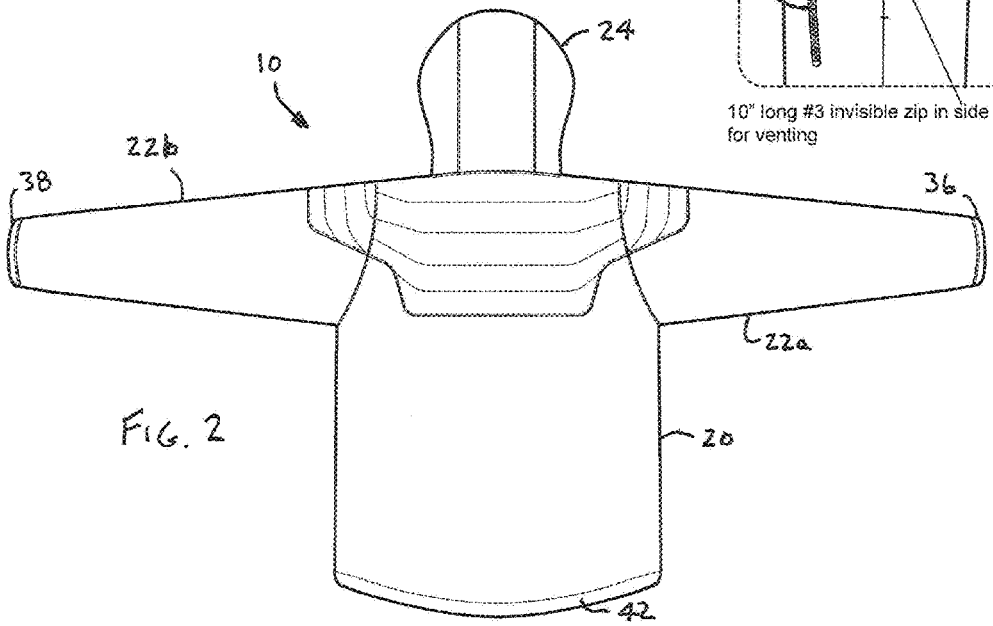
FIG. 2 is a rear elevational view of the convertible jacket.
Figure 4:
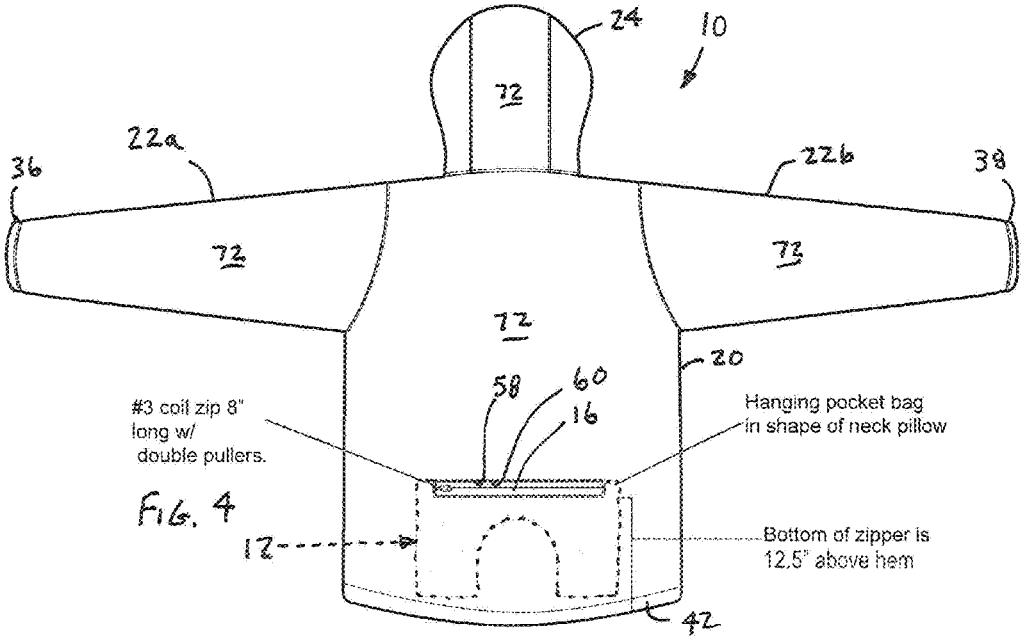
FIG. 4 is a rear elevational view of the convertible jacket with the jacket turned inside out to show the interior of the jacket.

A convertible jacket in accordance with an embodiment of the present invention is show in FIGS. 1-2. The jacket 10 includes a jacket storage pocket 12 that corresponds in shape with a neck pillow (See FIG. 4, which shows the jacket 10 turned inside out). The jacket storage pocket 12 is configured to allow the remainder of the garment 10 to be stuffed into the jacket storage pocket 12 to form a neck pillow 14 (See FIGS. 6-8). The jacket storage pocket 12 includes a closure 16 to secure the remainder of the jacket 10 in the jacket storage pocket 12. Although illustrated in connection with a hooded jacket construction, the present invention may be incorporated into other type of garments.

In the illustrated embodiment, the jacket 10 is a generally conventional zip-up, hooded jacket. The jacket 10 of the illustrated embodiment includes a front zipper 44. The jacket 10 may include other closures or may be a pullover garment. Referring now to FIG. 1, the jacket 10 includes a jacket body having a torso portion 20, a pair of sleeves 22*a-b* and a hood 24. The torso portion 20, sleeves 22*a-b* and hood 24 of the illustrated embodiment each include a layered construction. The layered construction may include a shell 70 (See FIG. 1), a lining 72 (See FIG. 3) and insulation (not shown). The shell 70 may be assembled from panels of one or more of polyester taffeta, a polyester woven fabric, such as Versatech®, or any other material suitable for a shell. The lining 72 may be assembled from panels of one or more of nylon taffeta, a nylon plain weave, polyester tricot or any other material suitable for a lining. The insulation may be down, synthetic fiberfill or essentially any other garment insulation. For example, in the illustrated embodiment the insulation is a polyester fiberfill. The shell 70, lining 72 and insulation may be assembled as desired. The jacket 10 may include regions of channel quilting or other forms of stitching configured to intersecure the shell 70, lining 72 and insulation.

Figure 5:
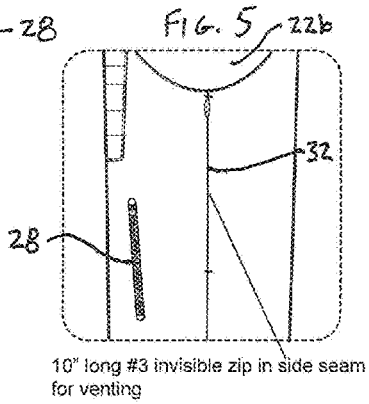
FIG. 5 is a side elevational view of a portion of the jacket.
Figure 3:
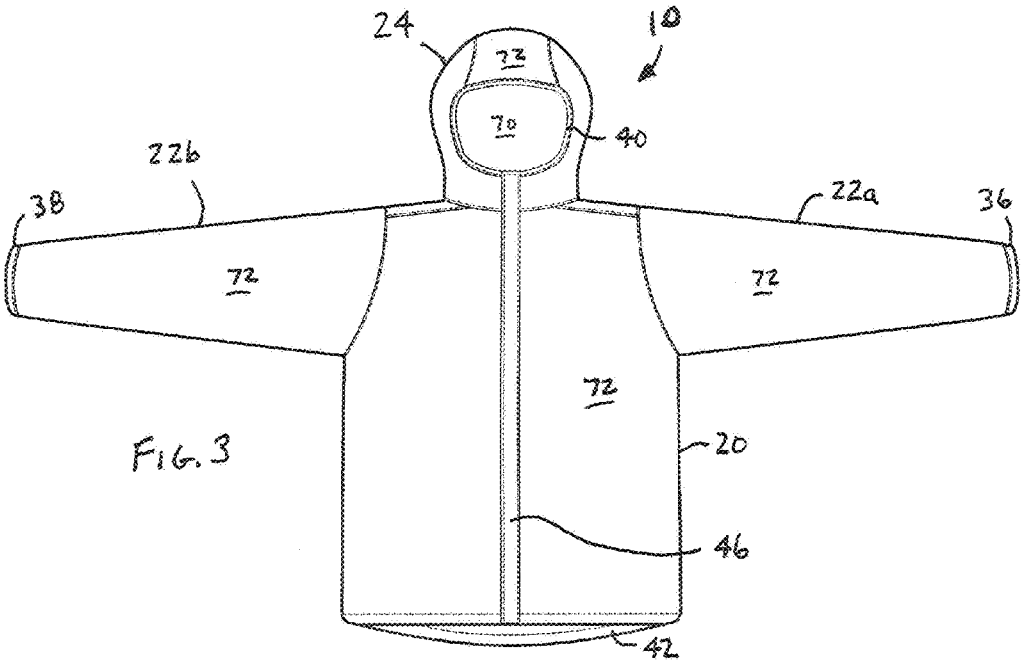
FIG. 3 is a front elevational view of the convertible jacket with the jacket turned inside out to show the interior of the jacket.

As shown, the jacket 10 may include a variety of accessories, such as pockets, cuffs and various trim elements. For example, referring to FIG. 1, the jacket 10 may include pockets 26, 28 and 30. These pockets 26, 28 and 30 may include closures, such as zippers, snaps or buttons. Referring now to FIGS. 1 and 3, the front zipper 44 may be fitted with a storm flap 46 and a chin guard 48. As another example shown in FIG. 5, closable vents 32 may be located in the sides of the jacket 10 to selectively vent the underarm regions of the jacket 10. The closable vents 32 may each include a closure, such as a zipper. Further, the cuffs 36 and 38 and hood opening 40 may be bound by a spandex material, such as Lycra®, or other similar materials. A spandex material is used in the illustrated embodiment to provide a certain amount of elasticity in the cuffs 36 and 38 and hood opening 40, while at the same time providing a comfortable and durable interface with the wearer's skin. If desired, the hem 42 may include one or more drawstrings (not shown).

The jacket storage pocket 12 of the illustrated embodiment is a hanging bag pocket disposed between the lining 72 and the insulation (not shown) when the convertible jacket 10 is being worn as a jacket. In the illustrated embodiment, the jacket storage pocket 12 is located in the center of the back of the jacket 10. The lining 72 defines an opening 58 to provide access to the jacket storage pocket 12. The jacket storage pocket 12 includes a mouth that defines a pocket opening 60. The mouth of the pocket 12 is joined to the lining 72 about the lining opening 58. As shown, the hanging bag pocket 12 hangs down from the pocket opening 60 and is situated high enough that the bottom of the pocket remains about the hem. For example, in the illustrated embodiment, the pocket opening 60 may be about 12.5 inches above the hem. The location and orientation of the jacket storage pocket 12 may vary from application to application, as desired. In the illustrated embodiment, the jacket storage pocket 12 is secured to the jacket 10 only around the pocket opening 60, which permits the hanging bag pocket to be pulled out from inside the lining 72 into an inside-out orientation. In the inside-out orientation, the hanging bag pocket forms a pouch oriented such that it can receive the remainder of the jacket 10.

Figure 6:
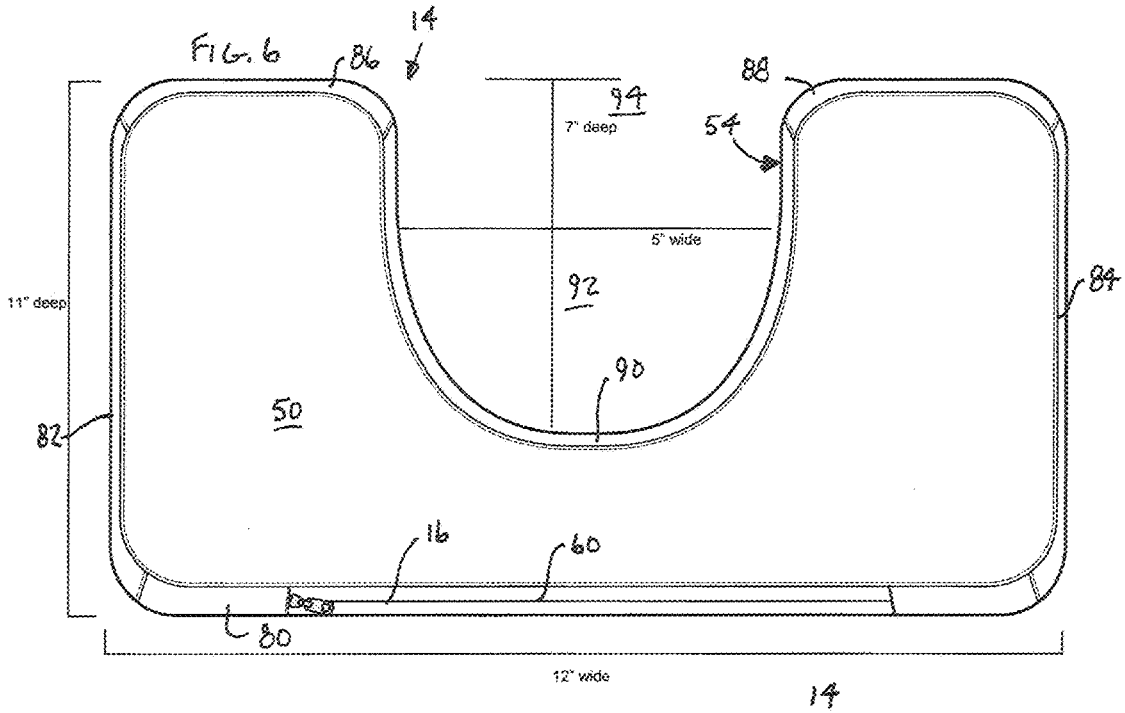
FIG. 6 is a top plan view of the convertible jacket reconfigured as a neck pillow.
Figure 7:
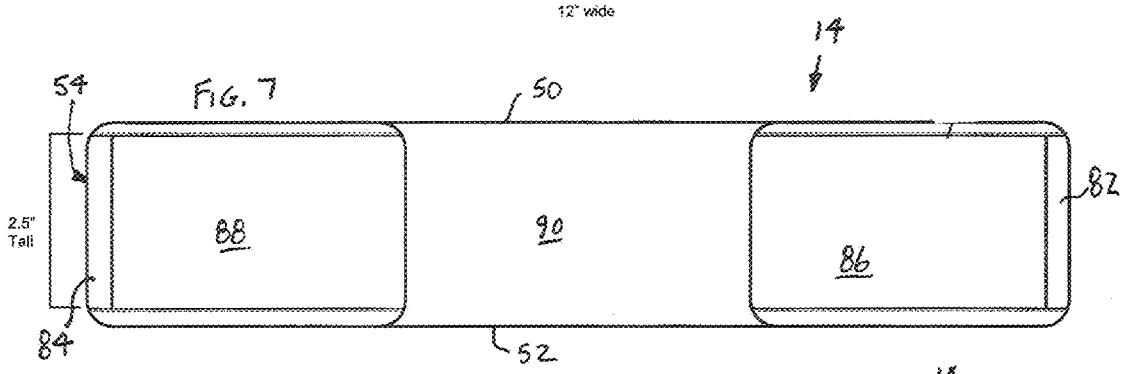
FIG. 7 is a front elevational view of the convertible jacket reconfigured as a neck pillow.
Figure 8:
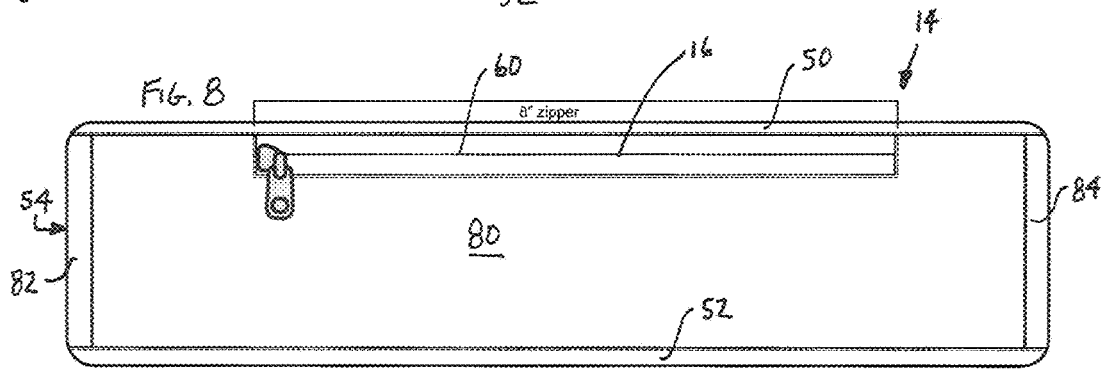
FIG. 8 is a rear elevational view of the convertible jacket reconfigured as a neck pillow.

The convertible jacket 10 is shown in the neck pillow 14 configuration in FIGS. 6-8. As shown, the jacket storage pocket 12 includes a top panel 50, a bottom panel 52 and a sidewall assembly 54. The various panels may be sewn or otherwise intersecured. In the illustrated embedment, the sidewall assembly 54 includes a rear panel 80, a left side panel 82, a right side panel 84, a left front panel 86, a right front panel 88 and an inside panel 90. The sidewall assembly 54 may alternatively be replaced by a single panel sidewall (not shown), such as a single strip of material that extends entirely around the circumference of the pocket 12. The sidewall assembly 54 joins the top panel 50 and the bottom panel 52 in a generally rectiplanar configuration as shown in FIGS. 6-8 (e.g. the top panel 50, bottom panel 52 and panels in the sidewall assembly 54 are generally planar). The top panel 50 and bottom panel 52 may be generally U-shaped providing a neck pillow structure that can be fitted around the back and sides of a neck. In this embodiment, the neck pillow 14 includes a central neck opening 92 shaped to follow the general contours of a neck. For example, the rear of the neck opening is curved to follow the general contour of the rear of a neck. In the illustrated embodiment, the mouth 94 of the neck opening 92 is essentially the same width as the neck opening 92. The mouth 94 may, however, have a different width than the neck opening 92. For example, the mouth 94 may be narrower than the neck opening 92 to help retain the neck pillow 14 on the wearer's neck. The shape and configuration of the jacket storage pocket 12 and consequently the neck pillow 14 may vary from application to application. For example, the number, size and shape of panels used to form the jacket storage pocket 12 may vary from application to application.

The jacket storage pocket 12 of the illustrated embodiment includes a closure, such as a zipper 16, to selectively close the pocket opening 60 and the lining opening 58. The zipper 16 may include double pulls (e.g. pulls on opposite sides of the zipper) so that the zipper 16 can easily be operated from both sides. Although the pocket 12 includes a zipper 16 in the illustrated embodiment, the pocket 12 may be closed by other types of closures, such as snaps, buttons or hook-and-loop fasteners (e.g. Velcro®) or the closure may be eliminated altogether. In the illustrated embodiment, the closure 16 is located at the top center of the rear panel 80 (See FIG. 8). For example, the closure 16 may be disposed along the seam between the top panel 50 and the rear panel 80, such that one longitudinal edge of the closure 16 is secured to the top panel 50 and the other is secured to the rear panel 80. The closure 16 may, however, be located in other positions in the jacket storage pocket 12. Although it may be desirable to locate the closure in a position where it does not engage the wearer's skin when the neck pillow 14 is in use, the present invention is not limited to applications in which the closure does not contact the wearer's skin. For example, in some applications it may be acceptable for the closure to engage the skin or the closure may include flaps or other cover elements that isolate the closure from the wearer's skin.

The jacket storage pocket 12 of the illustrated embodiment includes a shell (not shown) and a lining (See FIGS. 6-8). The shell and lining may be manufactured from essentially the same panels noted above and may be essentially coextensive. The shell may be manufactured from essentially any shell material, such as polyester taffeta. The jacket storage pocket 12 may be lined with a soft lining material that is comfortable to the touch, such as brushed tricot or fleece. In some application, the lining may be eliminated. For example, in some applications, it may not be necessary for the neck pillow 14 to have a soft outer material or the shell material may itself be soft enough to provide the desired level of comfort.

As noted above, the size and shape of the jacket storage pocket 12 is selected to provide a neck pillow shape when the convertible jacket 10 is configured as a neck pillow 14. Although the size and shape of the neck pillow 14 may vary from application to application as desired, the neck pillow 14 of the illustrated embodiment has a generally rectangular outer profile. The neck opening 92 is defined within the rectangular outer profile. In this embodiment, the neck pillow 14 has a height of approximately 2.5 inches, a width of approximately 12 inches and a depth of approximately 11 inches. The neck opening 92 has a curved inner surface, but is approximately 7 inches deep at its deepest point and approximately 5 inches wide at its widest point. The closure 16 may be approximately 8 inches in length. In other applications, the neck pillow 14 may be somewhat wedge-shaped, for example, being taller at the rear of the neck pillow than at the front of the neck pillow.

In the illustrated embodiment, the interior volume of the jacket storage pocket 12 and the volume of the jacket 10 are selected so that the jacket 10 substantially fills out the jacket storage pocket 12 and provides the neck pillow 14 with the desired firmness. For example, it is typically desirable for a neck pillow to have sufficient firmness to provide support for and hold the neck in a somewhat upright position. If the neck pillow allows the neck to bend too far, it can increase the likelihood of the wearer developing a sore neck during use. At the same time, it is typically desirable for the neck pillow to allow the head to tilt a sufficient distance for the head to feel like it is comfortably resting on the neck pillow.

Figure 9:
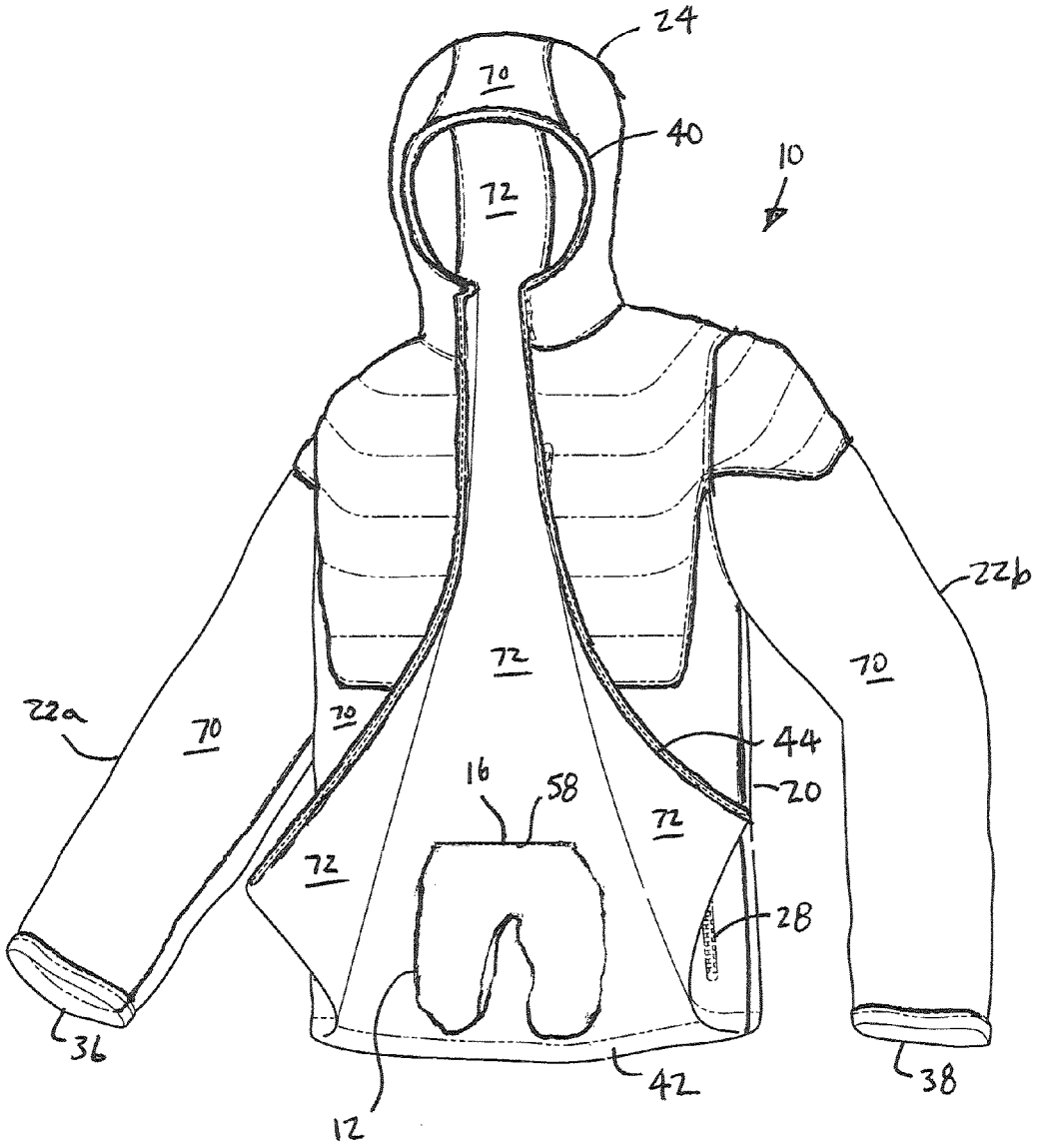
FIG. 9 is a perspective view of the convertible jacket with the jacket storage pocket pulled out from inside the jacket lining.
Figure 10:
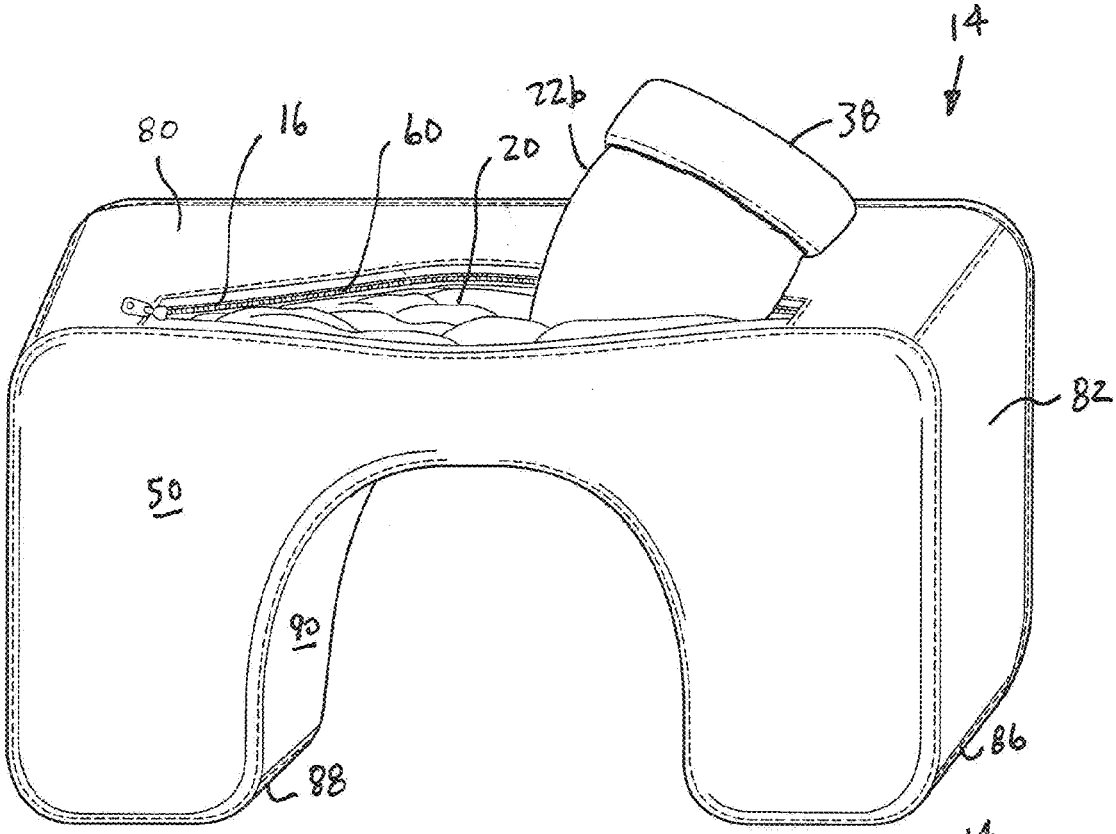
FIG. 10 is a perspective view of the convertible jacket in the process of being stuffed into the jacket storage pocket.
Figure 11:
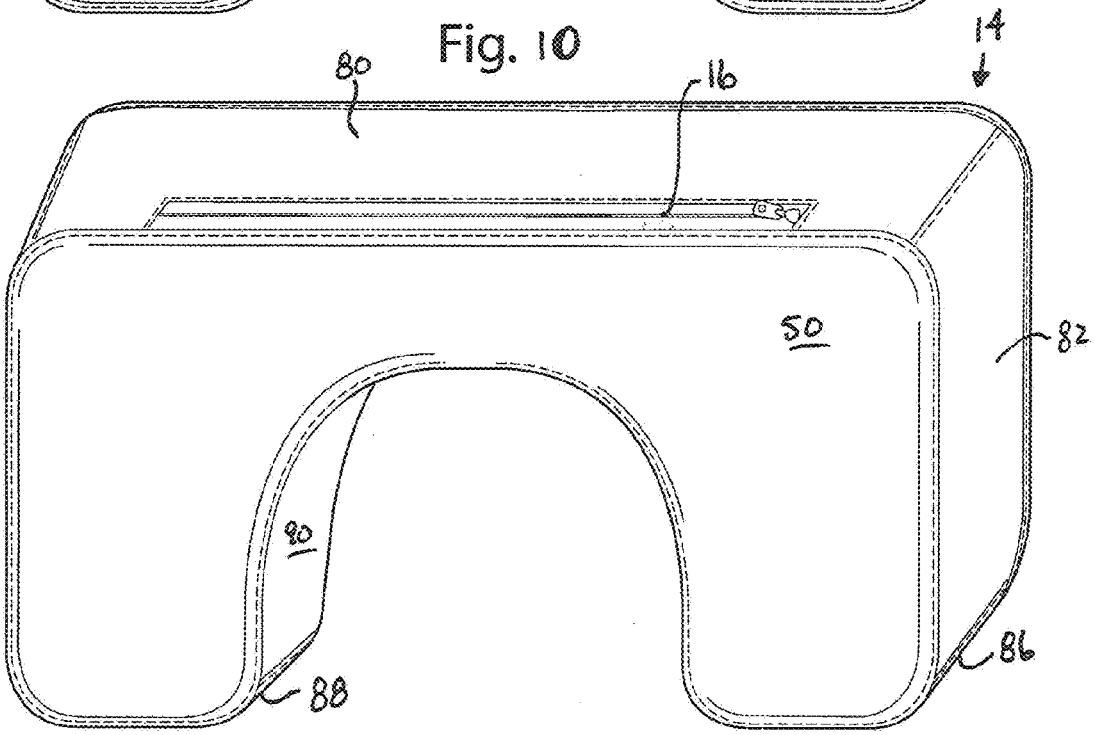
FIG. 11 is a perspective view of the convertible jacket reconfigured as a neck pillow.

When converting the jacket 10 into a neck pillow 14, the hanging bag pocket 12 may be unzipped and pulled out from inside the jacket 10 into an inverted (or inside-out) configuration (See FIG. 9). In this position, the jacket storage pocket 12 provides a somewhat U-shaped pouch with an opening that is oriented to receive the remainder of the jacket 10. The remainder of the jacket 10 may then be manually stuffed into the jacket storage pocket 12 to fill out the jacket storage pocket 12 and store the jacket 10 (See FIG. 10). Once the entire jacket 10 is fitted into the jacket storage pocket 12, the zipper 16 may be closed to secure the convertible jacket 10 in the neck pillow 14 configuration (See FIG. 11). The neck pillow 14 may then be fitted over the neck to provide support and cushioning for the wearer. The neck pillow 14 is easily returned to the jacket configuration by opening the zipper 16 and pulling the jacket 10 out from inside the jacket storage pocket 12.

The present invention also provides a method for properly sizing the jacket body and/or the jacket storage pocket 12 so that the neck pillow 14 has appropriate firmness. The method includes the steps of: (a) manufacturing the garment with a jacket storage pocket having starting dimensions (for example, the dimensions noted above), including the desired neck opening dimensions, (b) stuffing the garment into the jacket storage pocket to form a neck pillow, (c) evaluating the firmness of the neck pillow, and (d) if adjustment of the firmness is desired, adjusting the dimensions of at least one of the length or width of the jacket storage pocket while maintaining fixed neck opening dimensions. If desired, the height of the jacket storage pocket may also be held constant during the adjusting step. These steps may be repeated until a neck pillow of the desired firmness is achieved. As an alternative (or in addition) to adjusting the dimensions of the neck pillow, the amount of insulation in the garment may be adjusted to provide the desired firmness.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A convertible jacket comprising:

a jacket body having a shell and a lining, said lining having a front portion and a back portion, said back portion defining an opening;

a jacket storage pocket disposed between said shell and said lining, said jacket storage pocket defining a pocket opening, said jacket storage pocket secured to said back portion with said back portion opening aligned with said pocket opening, said jacket storage pocket being a U-shaped hanging bag pocket that is adapted to be removed from between said shell and said lining by pulling said U-shaped pocket out through said opening in said back portion, said U-shaped pocket including a pair of spaced apart leg portions adapted for placement on opposite sides of a wearer's neck joined by a cross portion, the spaced apart leg portions and the cross portion defining a central neck opening for receipt of a wearer's neck, said pocket opening being defined in said cross portion; and a closure for said pocket opening and said back portion opening, whereby actuation of said closure simultaneously opens and closes said pocket opening and said back portion opening;

wherein said jacket storage pocket includes a generally U-shaped top panel and a generally U-shaped bottom panel joined by a side panel assembly;

wherein said top panel and said bottom panel are substantially parallel to one another and said side panel assembly is substantially perpendicular to said top panel and said bottom panel;

wherein said side panel assembly includes a rear panel configured to face away from a wearer when the convertible jacket is in use as a neck pillow, said closure disposed in said rear panel;

wherein said jacket storage pocket has a capacity that is substantially equivalent to a compressed volume of said jacket body when said jacket body is stuffed into said jacket storage pocket, wherein said jacket body fills out said jacket storage pocket to provide a neck pillow of sufficient firmness to provide substantial support for a neck;

wherein said jacket storage pocket includes a durable shell and a soft lining material; and wherein said side panel assembly includes a left side panel, a left front panel, an inside panel, a right front panel and a right side panel.

2. The jacket of claim 1 wherein, when the convertible jacket is in use as a neck pillow, the left side panel is substantially parallel to the right side panel, and the left and right side panels are substantially perpendicular to the top panel and bottom panel.

3. The jacket of claim 2 wherein, when the convertible jacket is in use as a neck pillow, the left front panel, the right front panel and the rear panel are all substantially parallel to one another.

* * * * *